United States Patent [19]

Ochsner et al.

[11] Patent Number: 4,630,360

[45] Date of Patent: Dec. 23, 1986

[54] METHOD OF MAKING DIFFERENTIAL PRESSURE OPERATED ELECTRICAL SWITCH

[75] Inventors: Rolf H. Ochsner, Trumbull; Charles J. Everett, Clinton, both of Conn.

[73] Assignee: Robert Shaw Controls Company, Richmond, Va.

[21] Appl. No.: 723,065

[22] Filed: Apr. 15, 1985

[51] Int. Cl.[4] ..... H01H 35/38

[52] U.S. Cl. ..... 29/622; 200/82 R; 200/277; 340/626; 73/745; 417/13

[58] Field of Search ..... 200/82 R, 302, 243, 200/275, 81 R, 277, 284, 83 J; 307/118; 340/605, 626, 52 C; 73/745, 714; 417/13; 29/622

[56] References Cited

U.S. PATENT DOCUMENTS

| | | | |
|---|---|---|---|
| 3,621,167 | 11/1971 | Burke | 200/82 R |
| 3,919,509 | 11/1975 | Schnitzius | 340/52 C |
| 3,924,086 | 12/1975 | Ochsner | 200/82 R |
| 3,958,090 | 5/1976 | Garcia | 200/277 |
| 4,007,343 | 2/1977 | Alten | 200/83 J |
| 4,038,506 | 7/1977 | Filip | 200/83 J |
| 4,215,254 | 7/1980 | Ohki | 200/83 J |
| 4,300,601 | 11/1981 | Steinberg | 200/277 |
| 4,343,974 | 8/1982 | Hire | 200/83 J |
| 4,520,245 | 5/1985 | Ochsner | 200/82 R |

OTHER PUBLICATIONS

Copending patent application, Ser. No. 536,305, filed Sep. 27, 1983.

*Primary Examiner*—G. P. Tolin

*Attorney, Agent, or Firm*—Candor, Candor & Tassone

[57] ABSTRACT

A differential pressure operated electrical switch construction is provided and has a housing carrying a pair of rigid terminals and an electrical switch for electrically interconnecting the terminals together under the control of an actuator that is responsive to differential pressure acting across the same. The terminals have free ends angled toward each other and the switch comprises a movable contact member and a spring operatively associated therewith for urging the contact member into bridging contact with the free ends of the terminals to thereby place the terminals in electrical contact with each other.

9 Claims, 7 Drawing Figures

METHOD OF MAKING DIFFERENTIAL PRESSURE OPERATED ELECTRICAL SWITCH

BACKGROUND OF THE INVENTION

1. Field of the Invention

This invention relates to a new differential pressure operated electrical switch construction and to a method of making the same as well as to the use of such electrical switch construction in combination with a refrigerant compressor.

2. Prior Art Statement

It is known to provide a differential pressure operated electrical switch construction having a housing means carrying a pair of rigid terminals and an electrical switch means for electrically interconnecting the terminals together when the switch means is in one operating condition thereof and for electrically disconnecting the terminals from each other when the switch means is in another operating condition thereof, the housing means having actuator means responsive to differential pressure acting across the same and being operatively associated with the switch means to place the switch means in one condition thereof when having a certain differential pressure acting across the same and to place the switch means in the other condition thereof when having another certain differential pressure acting across the same. For example, see the U.S. patent to Ochsner, U.S. Pat. No. 3,924,086 wherein it appears that the switch means comprises a sealed reed switch that is operated by a magnet means of the actuator moving relative to the sealed reed switch and see the copending patent application of Rolf H. Ochsner, Ser. No. 536,305, filed Sept. 27, 1983 now U.S. Pat. No. 4,520,245, wherein one of the terminals has an end provided with a substantially rectangular opening passing transversely and completely therethrough and defining a substantially straight interior edge of the one terminal and the switch includes a movable switch blade having one end carried by the other terminal and having another end disposed in the opening for engaging against the edge to thereby place the terminals in electrical contact with each other.

SUMMARY OF THE INVENTION

It is a feature of this invention to provide a new differential pressure operated electrical switch construction wherein the need for capillary tubing is eliminated.

In particular, it was found, as set forth in the aforementioned copending patent application, Ser. No. 536,305, filed Sept. 27, 1983 now U.S. Pat. No. 4,520,245, that the prior known electrical switch construction that senses oil pressure as set forth in the aforementioned U.S. patent to Ochsner, U.S. Pat. No. 3,924,086, is subject to failure because of having the capillary tubing thereof easily broken whereby it was desired to provide an oil pressure sensing switch construction that does not need to have capillary tubing and which could be mounted in a bore of the apparatus having the lubricant system thereof monitored by such differential pressure operated electrical switch construction.

Accordingly, it was found according to the teachings of the invention set forth in the aforementioned copending patent application that a switching means for electrically connecting and disconnecting the terminals of the switch construction could be uniquely formed to operate in the high pressure sensing chamber thereof.

However, it was found according to the teachings of this invention that another switching means could be uniquely formed to operate in such high pressure sensing chamber of such a construction.

For example, one embodiment of this invention provides a differential pressure operated electrical switch construction having a housing means carrying a pair of rigid terminals and an electrical switch means for electrically interconnecting the terminals together when the switch means is in one operating condition thereof and for electrically disconnecting the terminals from each other when the switch means is in another operating condition thereof, the housing means having actuator means responsive to differential pressure acting across the same and being operatively associated with the switch means to place the switch means in the one condition thereof when having a certain differential pressure acting across the same and to place the switch means in the other condition thereof when having another certain differential pressure acting across the same. The terminals have free ends angled toward each other and the switch means comprises a movable contact member and a biasing means operatively associated with said contact member for urging the contact member into bridging contact with the free ends of the terminals and thereby place the switch means in the one condition thereof and for being out of engagement with the free ends of the terminals and thereby place the switch means in the other condition thereof.

Accordingly, it is an object of this invention to provide a new differential pressure operated electrical switch construction having one or more of the novel features of this invention as set forth above or hereinafter shown or described.

Another object of this invention is to provide a method of making such a differential pressure operated electrical switch construction, the method of this invention having one or more of the novel features of this invention as set forth above or hereinafter shown or described.

Another object of this invention is to provide a new combination of a refrigerant compressor and such differential pressure operated electrical switch construction, the combination of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
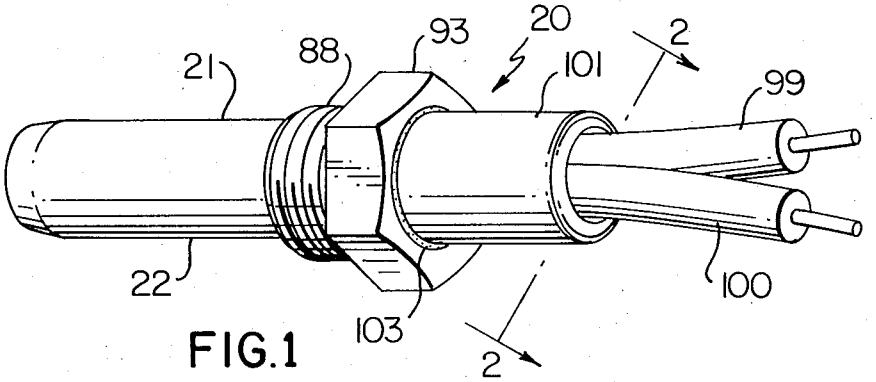
FIG. 1 is a perspective view of the differential pressure operated electrical switch construction of this invention.

While the various features of this invention are hereinafter illustrated and described as being particularly adapted to provide a differential pressure operated electrical switch construction for a compressor, it is to be understood that the various features of this invention can be utilized singly or in any combination thereof to provide a differential pressure operated electrical switch construction for other apparatus as desired.

Therefore, this invention is not to be limited to only the embodiment illustrated in the drawings, because the drawings are merely utilized to illustrate one of the wide variety of uses of this invention.

Referring now to FIGS. 1–6, the new differential pressure operated electrical switch construction of this invention is generally indicated by the reference numeral 20 and comprises a housing means 21 that includes an elongated substantially cylindrical tubular member 22 formed of metallic material or the like and having opposed open ends 23 and 24.

A pair of plug members 25 and 26 are respectively disposed in the open ends 23 and 24 of the tubular member 22 to close the open ends 23 and 24, the plug members 25 and 26 respectively being formed of electrically insulating material, such as plastic material, and being secured in the tubular member 22 in any suitable manner, such as by press-fitting, adhesive means, etc., as well as by a turning over of the respective open end 23 and 24 over the same as illustrated by the swaged end portions 27 of the open ends 23 and 24 for the plug members 25 and 26.

The plug member 26 carries a pair of substantially rigid and conductive terminals 28 and 29 that respectively have portions 30 and 31 molded or otherwise secured in the plug member 26 and respectively extend beyond opposed ends 32 and 33 of the plug member 26 while being inboard of the outer peripheral surface 34 of the plug member 26 so that the terminal members 28 and 29 are respectively electrically insulated from the tubular member 22, the portions 30 and 31 of the terminals 28 and 29 respectively having indentations or serrations 30' and 31' therein and receiving portions of the plug member 26 therein during the molding of the plug member 26 on the terminal portions 30 and 31 to reduce a possible leakage path along the terminals 28 and 29 and through the plug member 26.

The terminal members 28 and 29 respectively have outer ends 35 and 36 that extend outwardly beyond the surface 33 of the end plug 26 as well as beyond the open end 24 of the tubular member 22 to be interconnected into an electrical circuit (not shown) in a manner hereinafter set forth.

The other ends 37 and 38 of the terminals 28 and 29 are free ends that respectively extend beyond the end surface means 32 of the plug member 26 and define part of an electrical switch means that is generally indicated by the reference numeral 39 and is utilized to electrically interconnect the terminal members 28 and 29 together when the switch means 39 is in one condition thereof and for electrically disconnecting the terminals 28 and 29 from each other when the switch means 39 is in another operating condition thereof as will be apparent hereinafter.

The free ends 37 and 38 of the terminals 28 and 29 have been bent or angled toward each other as the same extend away from the end surface means 32 of the end plug 26 and confine a movable conductive contact member 40 of the switch means 39 therebetween as well as in a socket means 41 defined by the end surface means 32 as illustrated, the socket means 41 having an enlarged substantially cylindrical portion 42 receiving the contact member 40 and a smaller substantially frusto-conical portion 43 receiving a biasing means 44 that comprises a coiled compression spring 45 having opposed ends 46 and 47. The end 46 of the compression spring 45 engages against an end portion 48 of the end surface means 32 of the plug 26 and the other end 47 thereof engages against the contact member 40 to tend to urge the contact member into bridging contact with the free ends 37 and 38 of the terminals 28 and 29 in the manner illustrated in FIG. 2 to complete an electrical circuit between the terminals 28 and 29 for a purpose hereinafter described.

The contact member 40 comprises a metallic ball and is adapted to be disposed between the free ends 37 and 38 of the terminals 28 and 29 along with the compression spring 45 before the ends 37 and 38 are bent or angled toward each other as the terminals 28 and 29 are molded in the plug 25 with the free ends 37 and 38 thereof extending in substantially a straight parallel relation out of the end surface means 32 of the plug 25, the free ends 37 and 38 being bent in any suitable manner while each remaining substantially straight and making an angle of approximately 45° with the longitudinal axis of the plug 25.

The socket means 41 of the end plug 26 defines an annular frusto-conical portion 49 of the end surface means 32 which acts as a stop for the ball 40 when the same is moved away from the free ends 37 and 38 of the terminals 28 and 29 to interrupt the electrical circuit between the terminals 28 and 29 in the manner illustrated in FIG. 3 for a purpose hereinafter set forth.

Figure 2:
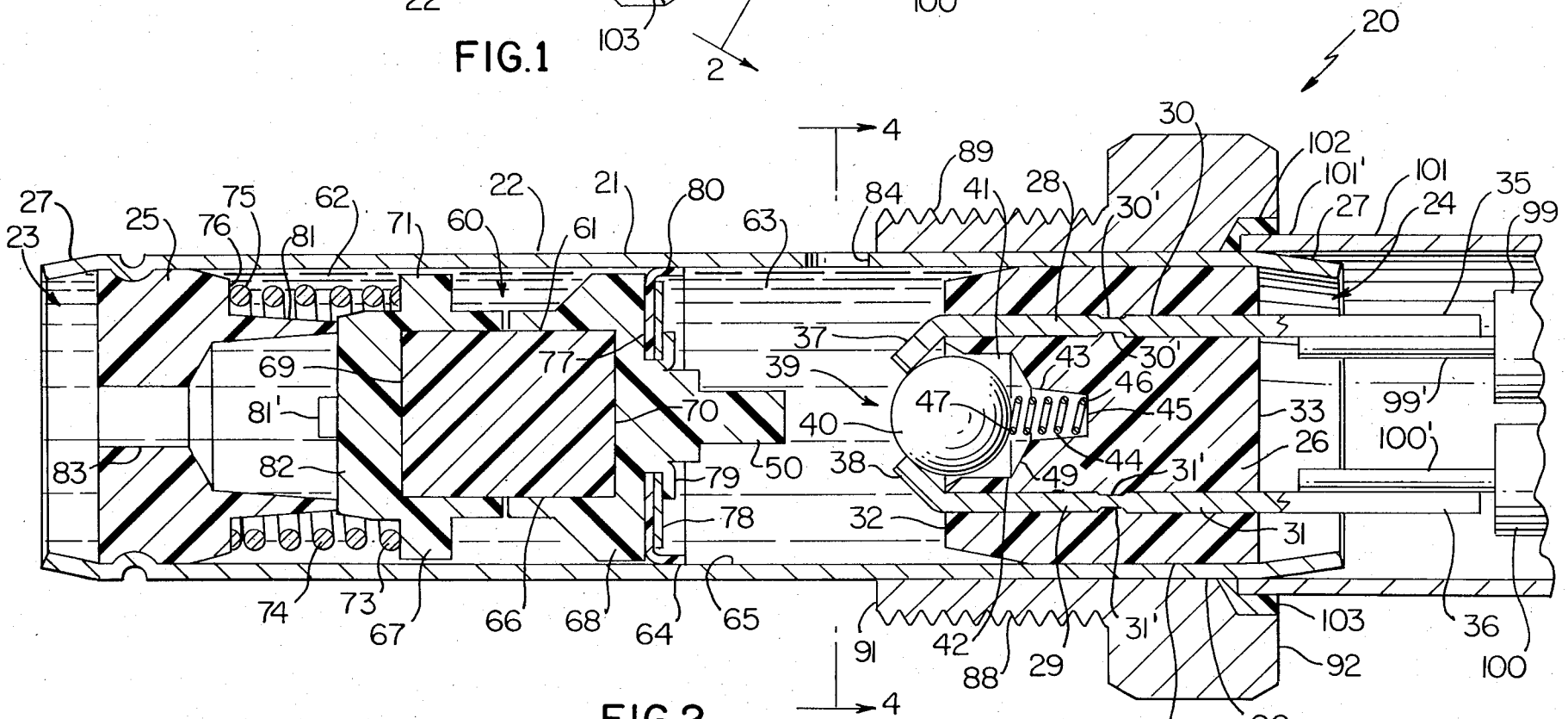
FIG. 2 is an enlarged cross-sectional view taken on line 2—2 of FIG. 1.

In particular, the ball 40 is adapted to be engaged by a cylindrical projection 50 of an actuator means that is generally indicated by the reference numeral 60 in FIG. 2 and is now to be described.

The actuator means 60 includes a movable piston means 61 that is disposed in the tubular housing member 22 and is adapted to separate the same into two chambers 62 and 63 because the same carries a flexible seal member 64 that seals against the internal peripheral surface 65 of the tubular member 22 while permitting axial movement of the piston member 61 therein.

Figure 3:
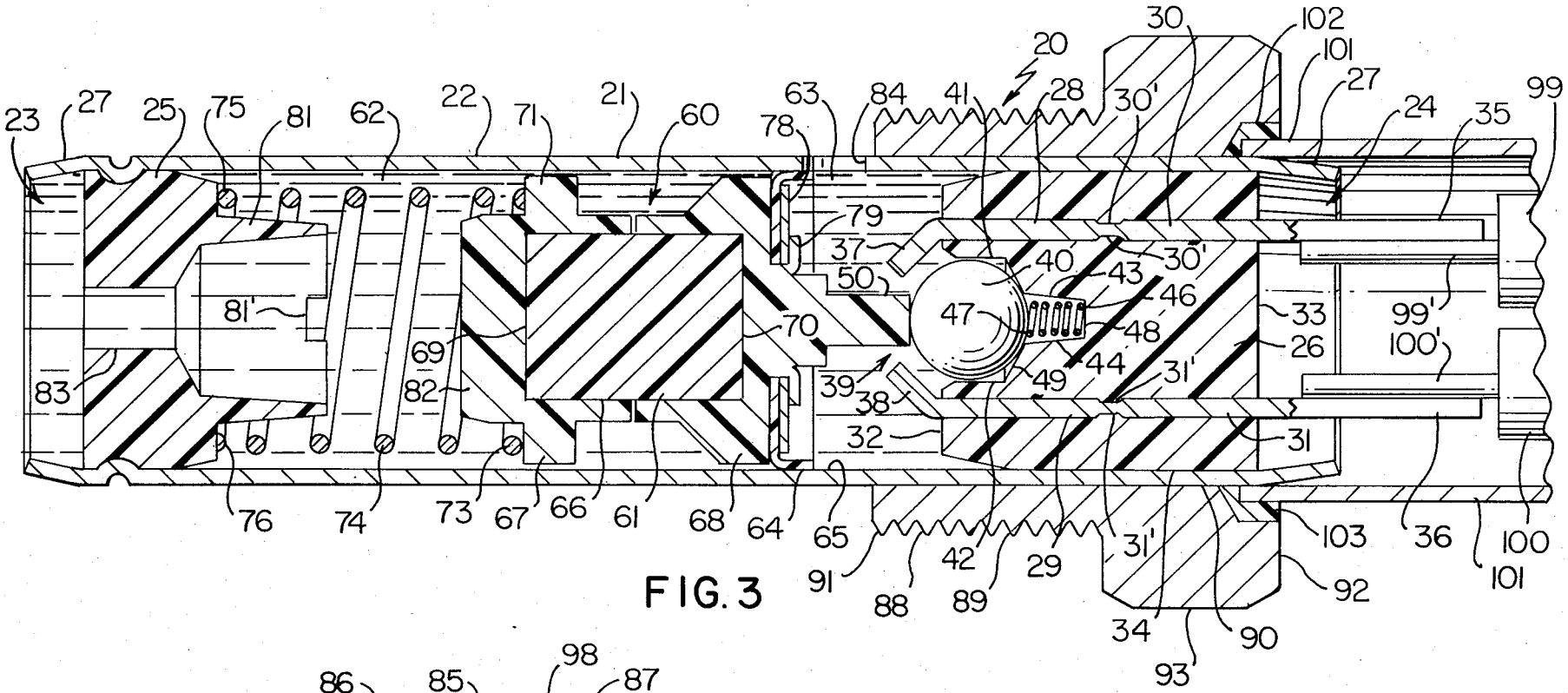
FIG. 3 is a view similar to FIG. 2 and illustrates the switch construction in another operating condition thereof.

In this manner, the chamber 62 is adapted to be interconnected to a low side of a pressure source and the chamber 63 is adapted to be interconnected to the high side of the pressure source so that the pressure differential acting across the piston 61 will cause the piston 61 to be positioned relative to the contact member 40 and thereby cause the contact member 40 to either electrically interconnect the terminals 28 and 29 together as illustrated in FIG. 2 or to electrically disconnect the terminals 28 and 29 from each other as will be apparent hereinafter and as illustrated in FIG. 3.

The piston means 61 can comprise a one-piece member or can comprise a plurality of parts as illustrated in the drawings. For example, the piston means 61 as illustrated comprises a substantially cylindrical member 66 which has a pair of piston members 67 and 68 respectively telescoped onto the opposed ends 69 and 70 thereof as illustrated with the piston members 67 and 68 being secured thereto in any suitable manner, such as being press-fit thereon, adhesively secured thereto, etc.

The piston member 67 has an annular disc-like flange 71 which acts as a spring retainer by defining an annular shoulder against which one end 73 of a coiled compression spring 74 engages while the other end 75 thereof bears against an annular shoulder 76 on the plug member 25 as illustrated in the drawings whereby the force of the compression spring 74 tends to axially move the piston means 61 in a direction to cause movement of the ball 40 away from the contact free ends 37 and 38 of the terminals 28 and 29 as will be apparent hereinafter.

The other piston part 68 carries the annular sealing member 64 and has an annular shoulder 77 against which the inner portion of the flexible sealing member 64 is held by a metallic washer-like member 78 which is placed against the sealing member 64 by a turned over portion 79 of the piston part 68 that is disposed inboard of the projection 50 thereof as illustrated in FIGS. 2 and 3.

Because the annular sealing member 64 originally comprises a substantially annular flat disc, the same has the outer peripheral portion 80 thereof turned at a right angle to the metallic member 78 so as to wipe against the internal peripheral surface 65 of the tubular member 22 and seal against the same, particularly because the chamber 63 is the high pressure chamber or side relative to the chamber 62 whereby the high pressure fluid in the chamber 63 causes the turned portion 80 to be urged against the peripheral surface 65 of the tubular member 22 to seal against the same.

The piston parts 66, 67 and 68 are formed from any suitable electrically insulating material, such as a plastic material, so as to prevent electrical connection from the contact member 40 to the tubular member 22.

As illustrated in FIGS. 2 and 3, the end plug or plug member 25 has a nose-like portion 81 that is adapted to extend into the compression spring 74 so as to provide a spring locating means therefor, the piston part 67 likewise having a nose end portion 82 for extending outwardly beyond the annular surface 72 into the compression spring 74 to provide a spring locating means for the end 73 thereof.

The plug member 25 has an opening 83 passing substantially centrally and completely therethrough whereby the opening 83 in the end plug 25 interconnects the open end 23 of the tubular member 22 to the chamber 62 so that the chamber 62 is adapted to be fluidly interconnected to a low pressure source, such as the suction side of the refrigerant system of the refrigerant compressor, through the open end 23 of the tubular member 22, the projection 81 of the plug 25 having opening means 81' to permit fluid to pass therethrough to the chamber 62 should the actuator 60 be against the projection 81 as illustrated in FIG. 2.

The high pressure chamber 63 is adapted to be interconnected to a high pressure source, such as the lubricant system for the refrigerant compressor, by an opening 84 formed through the tubular member 22 as illustrated in FIGS. 2 and 3, the end plug or plug member 26 sealing the chamber 63 from the end 24 of the tubular housing member 22.

Figure 7:
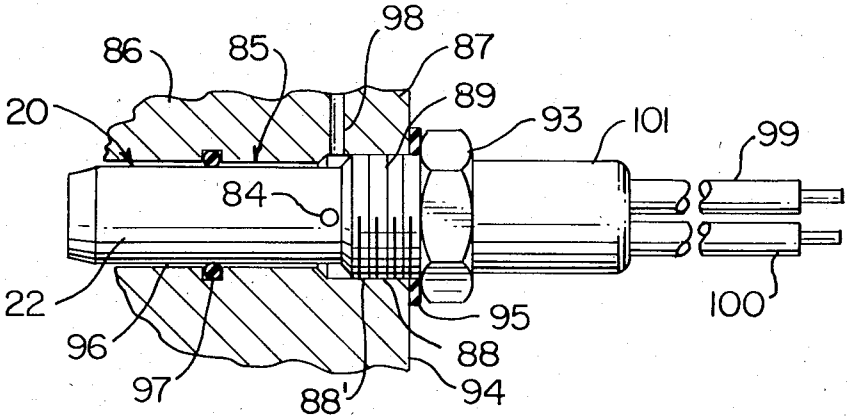
FIG. 7 is a reduced fragmentary view of the switch construction of this invention disposed in a compressor housing.
Figure 5:
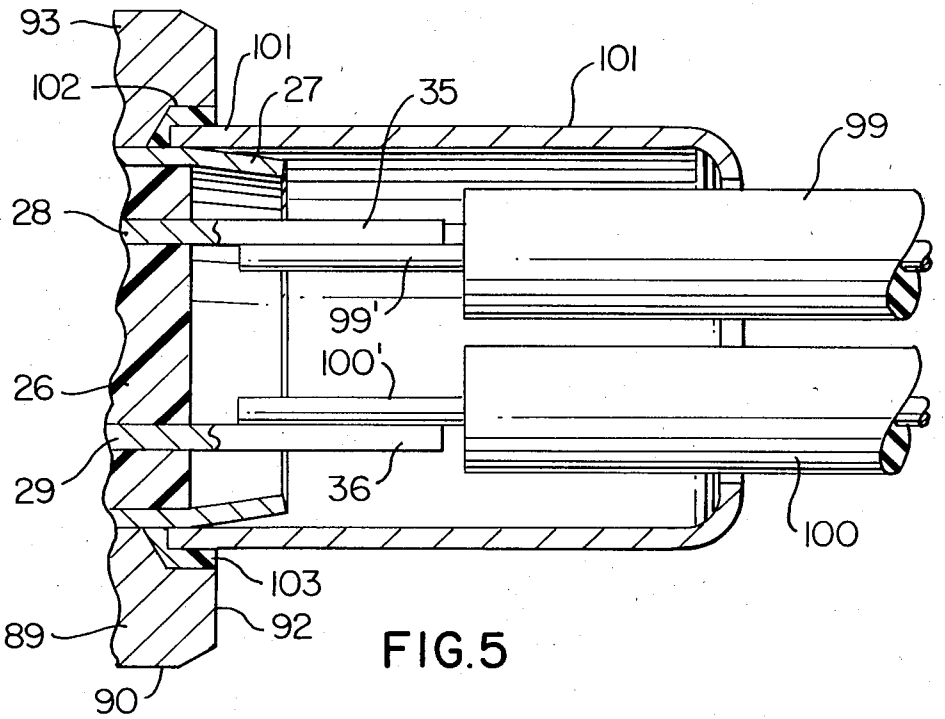
FIG. 5 is a fragmentary cross-sectional view of the end portion of the switch construction of FIG. 2.
Figure 4:
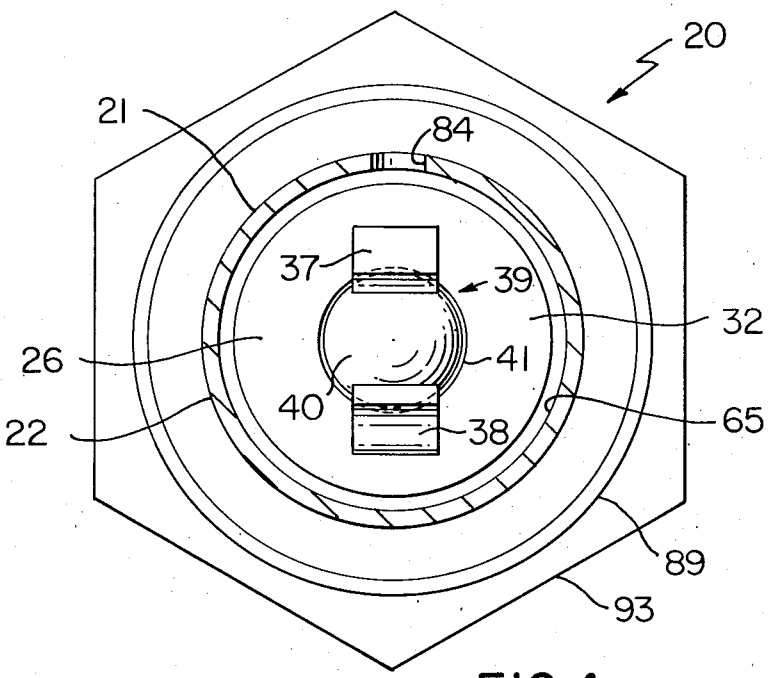
FIG. 4 is a cross-sectional view taken on line 4—4 of FIG. 2.
Figure 6:
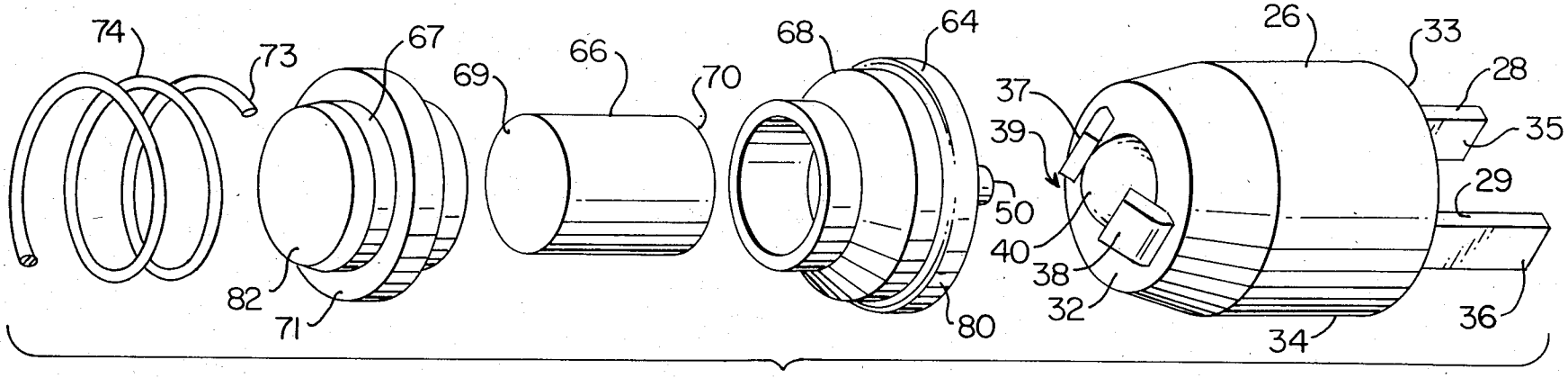
FIG. 6 is a reduced exploded perspective view of the switch construction of FIGS. 1–5.

In this manner, the differential pressure operated electrical switch construction 20 of this invention is adapted to be disposed in a passage means, that is generally indicated by the reference numeral 85 in FIG. 7, of a housing 86 of a refrigerant compressor 87 and be secured in such passage means 85 by an externally threaded portion 88 of a fastening member 89 that has the end 24 of the tubular member 22 disposed through an opening 90 passing through the opposed ends 91 and 92 of the fastening member 89 and being secured therein in any suitable manner, the external threads 88 of the fastening member 89 being threaded against internal threads 88' formed in the passage means 85 of the housing 86 so that the enlarged portion 93 of the fastening member 89 is adapted to seal against a surface 94 of the housing 86 by engaging against a sealing means 95 thereof carried by the housing means 86 as illustrated in FIG. 7. Of course, the end 91 of the fastening member 89 could seal against an O-ring seal (not shown) carried by the housing 86 in addition to the seal 95 or in lieu thereof, if desired. Likewise, the external peripheral surface 96 of the tubular member 22 of the switch construction 20 is adapted to seal against an annular O-ring-like sealing member 97 of the housing 86 that fluid seals the opening 84 in the tubular member 22 from the open end 23 thereof whereby the open end 23 is adapted to be disposed in fluid communication with the suction side or low pressure side of the refrigerant system of the compressor 87 while the opening 84 is adapted to be disposed in fluid communication with a passage means 98 in the housing 86 that leads to the lubricant system for the compressor 87.

In this manner, the differential pressure operated electrical switch construction 20 of this invention is adapted to be utilized in combination with the compressor 87 to protect the same from operating when there is insufficient oil pressure in the lubricant system thereof as will be apparent hereinafter and as set forth in the aforementioned U.S. patent to Ochsner, U.S. Pat. No. 3,924,086 and the aforementioned copending parent application, Ser. No. 536,305, filed Sept. 27, 1983 now U.S. Pat. No. 4,520,245, whereby such patent and patent application are being incorporated into this disclosure by this reference thereto.

If desired, the ends 35 and 36 of the terminals 28 and 29 can be electrically interconnected to the bared ends 99' and 100' of leads 99 and 100, such as by soldering, welding and the like, and the interconnection between the ends 35 and 36 of the terminals 28 and 29 and the leads 99 and 100 can be encapsulated with suitable encapsulating material, such as an epoxy, and the same can then be covered with a polyvinylchloride or metallic cover 101 as illustrated in the drawings which has its end 101' secured in an annular groove 102 in the end 92 of the fastening means 89 by adhesive means 103 so that the leads 99 and 100 can be electrically interconnected into the desired electrical circuit, such as the electrical circuit (not shown) for controlling the electric motor of the compressor 87 so that the electric motor for the compressor 87 will only operate as long as the switch means 39 electrically interconnects the terminal members 28 and 29 together. However, when the switch means 39 is in an open condition thereof so that the terminals 28 and 29 are not electrically interconnected, the electrical motor that drives the compressor 87 cannot operate so that the compressor 87 will not burn out by the failure of the lubricant system for the compressor 87 to provide sufficient oil pressure for lubricating the compressor as will be apparent hereinafter.

By selecting springs 74 and 45 of different force ratings when making the switch constructions 20, the pressure differential required to act across the piston 61 to open the switch means 39 can be any desired pressure differential with all of the other parts of the switch construction being the same.

Thus, it can be seen that it is a relatively simple method of this invention to form the switch construction 20 which is adapted to operate in the manner now to be described.

When the differential pressure operated electrical switch construction 20 of this invention has been inserted into the passage means 85 of the compressor 87 and the leads 99 and 100 have been interconnected into the electrical circuit (not shown) of the electrical motor for the compressor 87 so that the electrical motor for operating the compressor 87 will turn off when the switch means 39 is in an open condition and will operate when the switch means 39 is in a closed condition, the compression springs 74 and 45 have been so chosen that the same will assure that when a certain differential pressure acts across the piston means 61, such differential pressure overcomes the force of the compression spring 74 and moves the piston means 61 toward the conical end 81 of the plug 25 in the manner illustrated in FIG. 2 whereby the spring 45 forces the ball 40 to move to its closed condition in bridging contact with the free ends 37 and 38 of the terminals 28 and 29 to electrically interconnect the terminals 28 and 29 together.

For example, such certain differential pressure could be any pressure value over approximately 15 psig between the pressure value of the pressure fluid in the chamber 62 and the pressure value of the pressure fluid in the chamber 63. Of course, other certain pressure differentials could be selected depending upon the rates of the selected springs 74 and 45.

In any event, as long as the lubricant system of the compressor 87 is operating at a proper pressure value, the resulting pressure differential acting across the piston 61 causes the piston 61 to be to the left so that the spring 45 maintains the ball 40 in bridging contact with the free ends 37 and 38 of the terminals 28 and 29. However, should the pressure value of the lubricant being delivered by the lubricant system of the compressor 87 fall below a certain value so that the force of the compression spring 74 can move the piston means 61 to the right to have the projection 50 thereof move between the free ends 37 and 38 of the terminals 28 and 29 and engage against the ball 40 of the switch means 39 and move the ball 40 to the right against the stop surface 49 as illustrated in FIG. 3, the ball 40 will now be disposed out of electrical contact with the free ends 37 and 39 of the terminals 28 and 29 and thereby prevents electrical current flow between the terminals 28 and 29 so that the electric motor for the compressor 87 is in an inoperative condition and the compressor 87 will not be operated with the lubricant thereof at the low pressure value thereof which would cause the compressor 87 to be adversely affected as is well known in the art.

Accordingly, it can be seen that this invention not only provides a new differential pressure operated electrical switch construction and method of making the same, but also this invention provides a new combination of such a switch construction and a compressor.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a method of making a differential pressure operated electrical switch construction having a housing means carrying a pair of rigid terminals that have body portions thereof disposed substantially parallel to each other and an electrical switch means for electrically interconnecting said terminals together when said switch means is in one operating condition thereof and for electrically disconnecting said terminals from each other when said switch means is in another operating condition thereof, said method comprising the steps of disposing actuator means in said housing means so as to be responsive to differential pressures acting across the same, and operatively associating said actuator means with said switch means to cause said switch means to be in said one condition thereof when having a certain differential pressure acting across the same and to cause said switch means to be in said other condition thereof when having another certain differential pressure acting across the same, the improvement comprising the steps of bending the free ends of said terminals toward each other so that said free ends are each disposed at an angle relative to said body portion of its respective terminal, forming said switch means to comprise a movable contact member and a biasing means operatively associated with said contact member for urging said contact member into bridging contact with said free ends of said terminals and thereby cause said switch means to be in said one condition thereof and for permitting said contact member to be moved out of engagement with said free ends of said terminals and thereby cause said switch means to be in said other condition thereof, and disposing said contact member and said biasing means between said terminals before the step of bending said free ends of said terminals whereby said step of bending said free ends of said terminals confines said contact member and said biasing means between said terminals.

2. A method as set forth in claim 1 and including the step of forming said contact member to comprise a ball.

3. A method as set forth in claim 2 and including the step of disposing said ball so as to be confined in its movement by said free ends of said terminals.

4. A method as set forth in claim 3 and including the steps of forming said actuator means to comprise a movable piston disposed in said housing means and having opposed ends respectively adapted to be subjected to said differential pressure, and forming one of said ends of said piston to be movable between said free ends of said terminals and thereby be engageable with said ball to cause movement thereof.

5. A method as set forth in claim 4 and including the step of disposing a stop in said housing means so as to be adapted to be engaged by said ball when said ball is moved by said piston to cause said switch means to be in said other operating condition thereof.

6. A method as set forth in claim 5 and including the steps of forming said housing means to comprise a tubular member having opposed open ends, disposing an electrically insulating plug member in one of said ends of said tubular member to close the same, forming said plug member to carry said terminals and have an end surface means that defines said stop, extending said free ends of said terminals beyond said surface means, forming said biasing means to comprise a coiled compression spring, and disposing said spring between said surface means and said ball.

7. A method as set forth in claim 6 and including the steps of forming said housing means to have two chambers therein that are separated by said actuator means and are respectively adapted to receive pressure fluid therein having different pressure values to provide said differential pressure acting across said actuator means, and disposing said ball in one of said chambers so as to be exposed to the fluid therein.

8. A method as set forth in claim 1 wherein said step of bending the free ends of said terminals toward each other causes said free ends to each be disposed at substantially a 45° angle relative to said body portion of its respective terminal.

9. A method as set forth in claim 8 and including the step of forming said contact member to comprise a ball whereby said biasing means wedges said ball into bridging contact with free ends of said terminals when said switch means is in said one condition thereof.

* * * * *